US010240598B2

(12) United States Patent
Knoeller et al.

(10) Patent No.: US 10,240,598 B2
(45) Date of Patent: Mar. 26, 2019

(54) VALVE FOR A DOWNHOLE PUMP

(71) Applicant: Weatherford Technology Holdings, LLC, Houston, TX (US)

(72) Inventors: Michael C. Knoeller, Humble, TX (US); Gabriel Lugo, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 128 days.

(21) Appl. No.: 15/215,200

(22) Filed: Jul. 20, 2016

(65) Prior Publication Data

US 2017/0030340 A1 Feb. 2, 2017

Related U.S. Application Data

(60) Provisional application No. 62/197,457, filed on Jul. 27, 2015.

(51) Int. Cl.

| | |
|---|---|
| ***E21B 43/12*** | (2006.01) |
| ***F04B 53/16*** | (2006.01) |
| ***F04B 47/02*** | (2006.01) |
| ***F04B 53/10*** | (2006.01) |

(52) U.S. Cl.

CPC ..... *F04B 53/16* (2013.01); *E21B 43/129* (2013.01); *F04B 47/02* (2013.01); *F04B 53/10* (2013.01)

(58) Field of Classification Search

CPC ..... E21B 43/129

USPC ..... 166/369

See application file for complete search history.

(56) References Cited

U.S. PATENT DOCUMENTS

| | | | | |
|---|---|---|---|---|
| 4,369,022 | A * | 1/1983 | Roeder | F04B 53/103 137/516.11 |
| 8,303,272 | B2 | 11/2012 | Pugh et al. | |
| 2008/0003118 | A1* | 1/2008 | Traylor | F04B 43/107 417/394 |
| 2010/0230091 | A1* | 9/2010 | Pugh | E21B 43/129 166/68.5 |
| 2013/0195685 | A1* | 8/2013 | Robison | F16K 15/00 417/53 |

* cited by examiner

*Primary Examiner* — Taras P Bemko

(74) *Attorney, Agent, or Firm* — Patterson + Sheridan, LLP

(57) ABSTRACT

A valve assembly includes a valve body having a first port and a second port, the first port forms a fluid pathway from a first surface of the valve body to a second surface of the valve body, and the second port forms a fluid pathway from the second surface of the valve body to a third surface of the valve body. The valve assembly also includes a first plate having a first blocking member, the first blocking member configured to block the first port at the first surface of the valve body when the first plate is in a first closed position. The valve assembly also includes a second plate having a second blocking member, the second blocking member configured to block the second port at the second surface of the valve body when the second plate is in a second closed position.

20 Claims, 5 Drawing Sheets

VALVE FOR A DOWNHOLE PUMP

BACKGROUND OF THE INVENTION

Field of the Invention

Embodiments of the present invention generally relate to valves for use in downhole pumps.

Description of the Related Art

Pumps can be used in wells to help bring production fluids (such as gas or other hydrocarbons) to the surface. This is often referred to as providing artificial lift, as the reservoir pressure is insufficient for the production fluid to reach the surface on its own.

One type of pump for such operations is a hydraulically-actuated double-acting piston pump. This type of pump is typically deployed downhole in tubing, which is disposed in a wellbore casing. Surface equipment injects power fluid (e.g., produced water or oil) down the tubing to the pump. The power fluid operates to drive an engine piston internally between upstrokes and downstrokes which, in turn, drives a pump piston connected to the engine piston via a rod.

During alternating strokes, the pump simultaneously draws in production fluid into the tubing and discharges production fluid out of the tubing. The production fluid discharged from the pump accumulates and rises to the surface for handling.

Hydraulic piston pumps often include check valves to control production fluid flow during the upstrokes and downstrokes. Assuming a pump that operates in a manner described above, a first check valve discharges production fluid during an upstroke while a second check valve collects production fluid. During a downstroke, the first check valve collects production fluid while the second check valve discharges production fluid.

There is a need for improved check valves to control production fluid flow during the strokes of the pump.

SUMMARY OF THE INVENTION

In one embodiment, a valve assembly includes a valve body having a first port and a second port, the first port forms a fluid pathway from a first surface of the valve body to a second surface of the valve body, and the second port forms a fluid pathway from the second surface of the valve body to a third surface of the valve body; a first plate having a first blocking member, the first blocking member configured to block the first port at the first surface of the valve body when the first plate is in a first closed position; and a second plate having a second blocking member, the second blocking member configured to block the second port at the second surface of the valve body when the second plate is in a second closed position.

In another embodiment, a method of forming a valve assembly includes providing a valve body with a port that forms a fluid pathway from a first surface of the valve body to a second surface of the valve body, wherein the port at the first surface forms a seat; disposing a blocking member in the seat; and attaching a plate to the blocking member disposed in the seat.

In another embodiment, a pump assembly includes a pump piston designed to move up and down in alternating strokes between an upper pump volume and a lower pump volume; and a first and second valve assemblies, each valve assembly comprising: a valve body with an outlet port and an inlet port, a first plate having a blocking member coupled thereto for blocking the outlet port when the first plate is in a closed position, and a second plate having a blocking member coupled thereto for blocking the inlet port when the second plate is in a closed position, wherein the first valve assembly allows fluid out of the upper pump volume via the outlet port in the first valve body during an upstroke of the pump piston, and allows fluid into the upper pump volume via the inlet port in the first valve body during a downstroke of the pump piston, and wherein the second valve assembly allows fluid out of the lower pump volume via the outlet port in the second valve body during the downstroke of the pump piston, and allows fluid into the lower pump volume via the inlet port in the second valve body during the upstroke of the pump piston.

In another embodiment, a method of pumping fluid from a wellbore includes deploying a pump assembly into the wellbore, the pump assembly having a pump piston and a first and second valve assembly, each valve assembly comprising: a valve body with an outlet port and an inlet port, a first plate coupled with a blocking member for blocking the outlet port when the first plate is in a closed position, and a second plate coupled with a blocking member for blocking the inlet port when the second plate is in a closed position; driving the piston pump in an upstroke, thereby unseating the blocking member of the first plate in the first valve assembly and unseating the blocking member of the second plate in the second valve assembly; and driving the piston pump in a downstroke, thereby unseating the blocking member of the second plate in the first valve assembly and unseating the blocking member of the first plate in the second valve assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present disclosure generally relate to a piston pump with an upper and lower valve assembly for pumping fluid from a wellbore.

Figure 1:
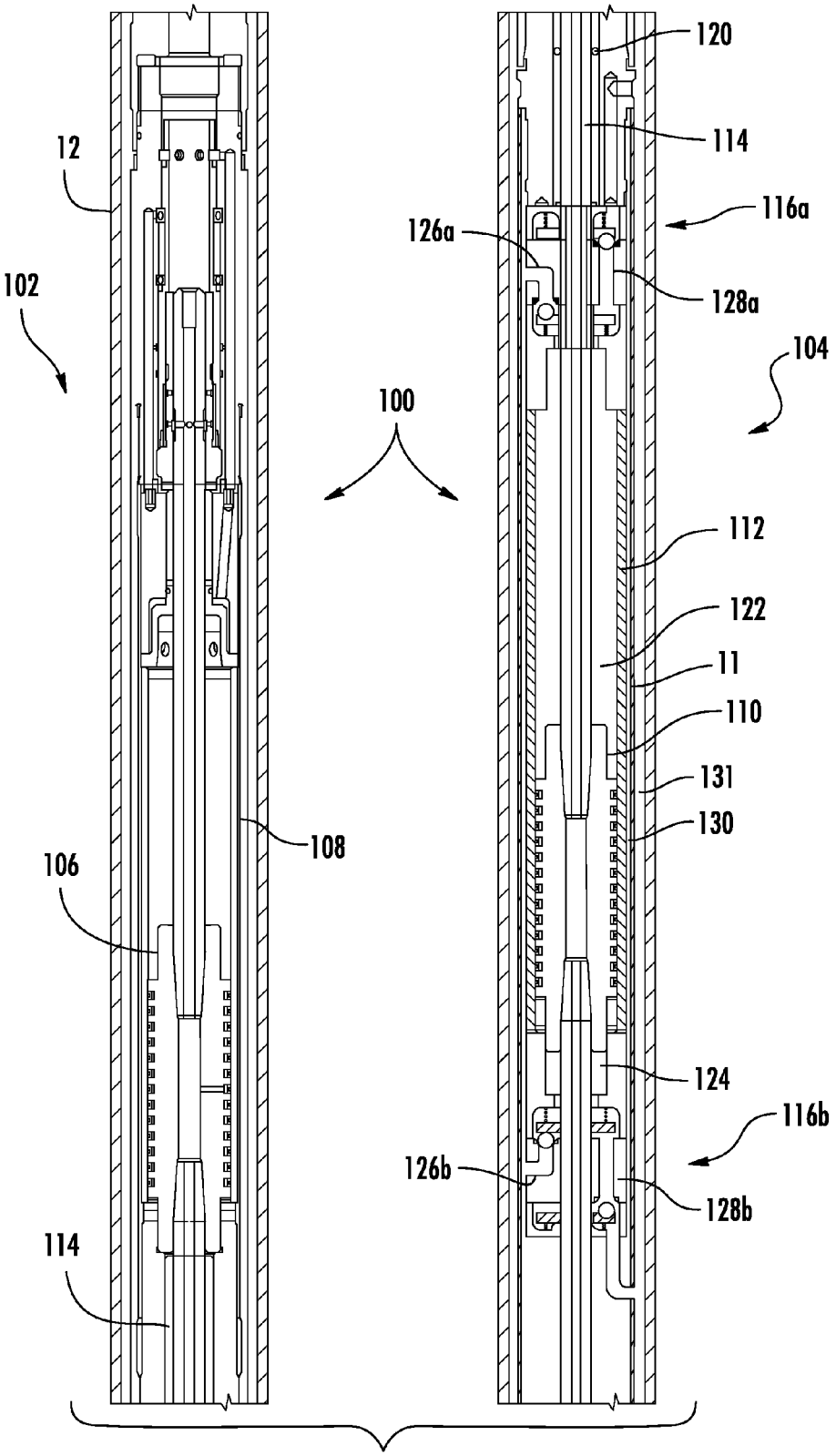
FIG. 1 illustrates an embodiment of a system for pumping fluid from a wellbore.

FIG. 1 illustrates an embodiment of a pump system 100 for pumping fluid from a wellbore. The pump system 100 is housed in a tubular 12, such as production tubing 12. In one embodiment, the production tubing 12 is disposed in a casing. The pump system 100 generally includes an engine section 102 and a pump section 104. The engine section 102, such as the engine section disclosed in U.S. Pat. No. 8,303,272, which is incorporated herein by reference, has an engine piston 106 movably disposed within an engine barrel 108. Similarly, the pump section 104 has a pump piston 110 movably disposed in a pump barrel 112. The pump piston 110 divides the pump barrel 112 between an upper pump volume 122 and a lower pump volume 124. An upper valve assembly 116*a* is disposed at an upper end of the pump barrel 112 and a lower valve assembly 116*b* is disposed at a lower of the pump barrel 112. In one embodiment, the upper and lower valve assemblies 116*a*, 116*b* and the pump barrel 112 are disposed in an outer tube 11, thereby forming an annulus 130 therebetween. The annulus 130 is in fluid communication with production fluid (such as gas or other hydrocarbons) in a formation via a flow path in the pump system 100. The outer tube 11 and the production tubing 12 form an annulus 131 for collecting exhausted production fluid from the upper and lower valve assemblies 116*a*, 116*b*. In one embodiment, the upper valve assembly 116*a* and the lower valve assembly 116*b* are substantially similarly constructed except that the lower valve assembly 116*b* is inverted relative to the orientation of the upper valve assembly 116*a*. For convenience, the components of the upper and lower valve assemblies 116*a*, 116*b* that are similar to each other are labeled with the same reference indicator and an "a" or "b," indicating components belonging to the upper valve assembly 116*a* or lower valve assembly 116*b*, respectively.

A rod 114 interconnects the engine piston 106 and the pump piston 110 such that the engine piston 106 and the pump piston 110 move in tandem in their respective barrels. The rod 114 passes through a sealing element 120, such as a seal ring. The sealing element 120 prevents fluid from passing on the outside of the rod 114 between the engine and pump barrels 108, 112.

The engine piston 106 is hydraulically actuated between upward and downward strokes by power fluid communicated from a surface of the wellbore to the pump system 100. As the engine piston 106 strokes, the pump piston 110 alternatingly sucks in production fluid into the upper and lower pump volumes 122, 124 and alternatingly discharges production fluid out of the upper and lower pump volumes 122, 124. For example, during an upstroke, production fluid in the annulus 130 is drawn into the lower pump volume 124 via an inlet port 126*b* in the lower valve assembly 116*b*, while production fluid is discharged from the upper pump volume 122 to the annulus 131 via an outlet port 128*a* in the upper valve assembly 116*a*. During a downstroke, production fluid in the annulus 130 is drawn into the upper pump volume 122 via an inlet port 126*a* in the upper valve assembly 116*a*, while production fluid is discharged from the lower pump volume 124 to the annulus 131 via an outlet port 128*b* in the lower valve assembly 116*b*. In one embodiment, the production fluid discharged through the outlet ports 128*a*, 128*b* collects in the annulus 131 until the production fluid reaches the surface.

Figure 2A:
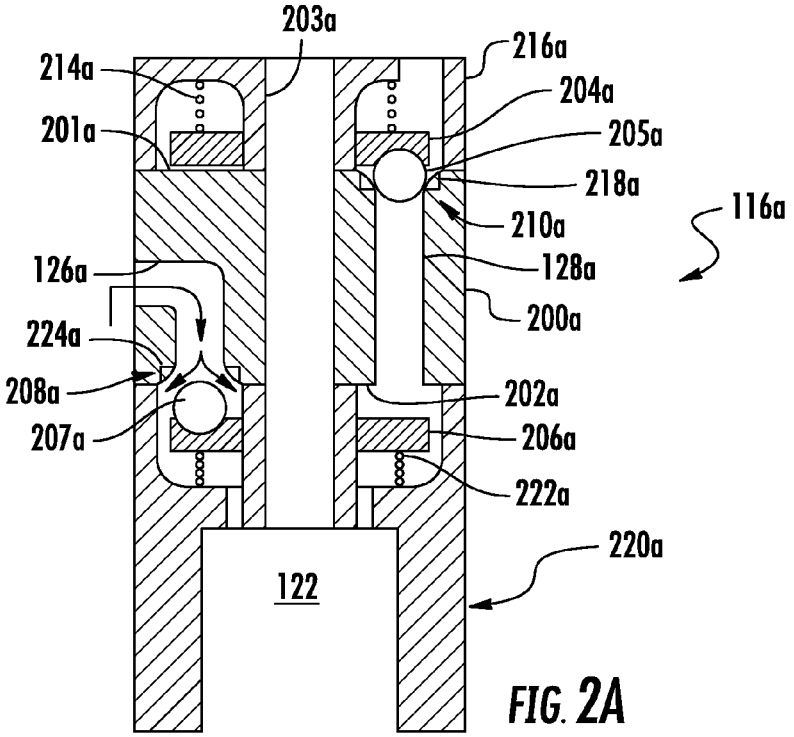
FIG. 2A is a section view of an exemplary upper valve assembly during a downstroke.
Figure 2B:
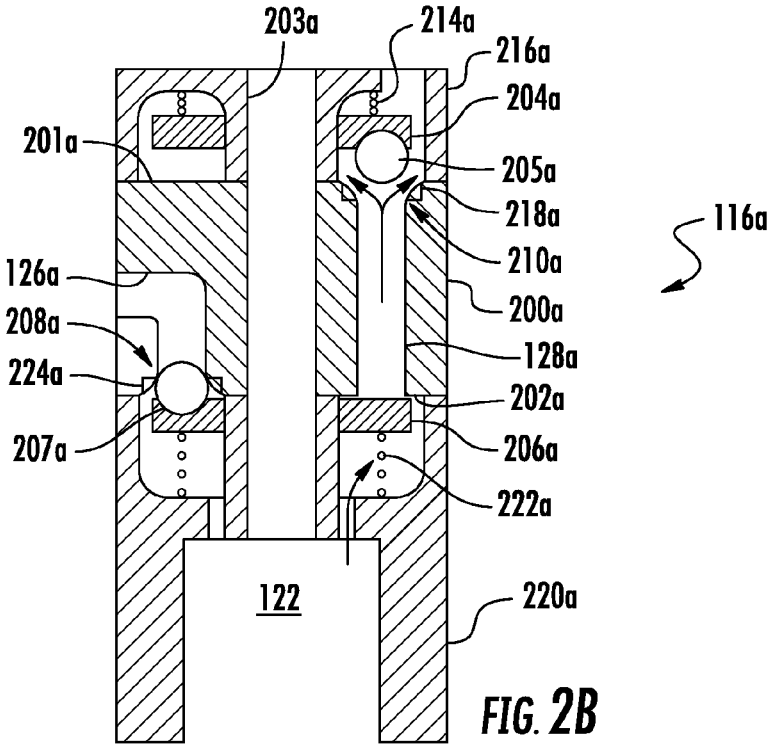
FIG. 2B is a section view of the upper valve assembly of FIG. 2A during an upstroke.

An exemplary embodiment of the upper valve assembly 116*a* is shown in FIGS. 2A and 2B. FIG. 2A shows the upper valve assembly 116*a* during the downstroke of the pump piston 110. During the downstroke, the upper valve assembly 116*a* draws fluid into the upper pump volume 122 via the inlet port 126*a*, while blocking a backflow of fluid into the upper pump volume 122 through the outlet port 128*a*.

The upper valve assembly 116*a* includes a bore 203*a* therethrough for receiving the rod 114. The upper valve assembly 116*a* also includes a valve body 200*a* having the inlet port 126*a* and the outlet port 128*a*, as shown in FIGS. 2A and 2B. In one embodiment, the outlet port 128*a* forms a fluid pathway from the upper pump volume 122 to the annulus 131. The outlet port 128*a* includes a seat 210*a* for receiving a first blocking member 205*a* of an exhaust plate 204*a*. In some embodiments, the first blocking member 205*a* is only free to rotate, if at all, about an axis that is parallel with the outlet port 128*a*. In some embodiments, the first blocking member 205*a* is not free to rotate relative to the outlet port 128*a*. The first blocking member 205*a* may be coupled to the exhaust plate 204*a*. For example, in one embodiment, the exhaust plate 204*a* and the first blocking member 205*a* are integrally formed. For example, the exhaust plate 204*a* and the first blocking member 205*a* are machined from a single piece of material, such as steel. In another embodiment, the first blocking member 205*a* is attached to the exhaust plate 204*a*. For example, to attach the exhaust plate 204*a* to the first blocking member 205*a*, the first blocking member 205*a* is disposed in the seat 210*a* formed by the outlet port 128*a*. Next, the exhaust plate 204*a* is attached to the first blocking member 205*a* while the first blocking member 205*a* is disposed in the seat 210*a*. The exhaust plate 204*a* may be attached to the first blocking member 205*a* using any suitable method of adhesion, including brazing, welding, and/or gluing. An exhaust cage 216*a* may then be attached to the valve body 200*a*. An optional biasing member 214*a* may be disposed between the exhaust plate 204*a* and the exhaust cage 216*a* when the exhaust cage 216*a* is attached to the valve body 200*a*.

In one embodiment, the exhaust plate 204*a* with first blocking member 205*a* is movably disposed in an exhaust cage 216*a* between an open position (FIG. 2B) and a closed position (FIG. 2A). The exhaust plate 204*a* may be biased toward the closed position by a biasing member 214*a*, such as a spring, which is disposed between the exhaust plate 204*a* and the exhaust cage 216*a*. In the closed position, the first blocking member 205*a* contacts the seat 210*a* to block the outlet port 128*a*, as shown in FIG. 2A. The first blocking member 205*a* may or may not hermetically seal the outlet port 128*a* in the closed position. The biasing member 214*a* and a hydrostatic pressure in the annulus 131 may act on the exhaust plate 204*a* such that the first blocking member 205*a* engages the seat 210*a* to block the outlet port 128*a*. For example, when the hydrostatic pressure in the annulus 131 is greater than the fluid pressure in the upper pump volume 122, the first blocking member 205*a* moves towards the closed position. The first blocking member 205*a* may have any appropriate shape capable of mating with the seat 210*a*, such as a conical solid, a rectangular solid, or an ellipsoid. In one embodiment, the first blocking member 205*a* is a ball, as shown in FIGS. 2A and 2B. The seat 210*a* may include a mating surface having a contoured profile corresponding to the shape of the first blocking member 205*a*. In one example, the seat 210*a* includes a rounded mating surface, i.e., a radius cut, for engaging the first blocking member 205*a* as shown in FIGS. 2A and 2B. In another example, the seat 210*a* includes a mating surface forming a 90 degree angle, i.e., a 90 degree cut, for engaging the first blocking member 205*a*. The seat 210*a* may also include a carbide insert 218*a* at the mating surface, as shown in FIGS. 2A and 2B.

In operation, the exhaust plate 204*a* with first blocking member 205*a* moves to the closed position during the downstroke of the pump piston 110. For example, the upper pump volume 122 increases during the downstroke, thereby causing a fluid pressure decrease in the upper pump volume 122. In turn, a fluid pressure differential is created across the exhaust plate 204*a* whereby the hydrostatic pressure in the annulus 131 is greater than the fluid pressure in the upper pump volume 122. The biasing member 214*a* and/or the hydrostatic pressure in the annulus 131 act on the exhaust plate 204*a* such that the first blocking member 205*a* is urged against the seat 210*a*. As a result, the first blocking member 205*a* blocks the backflow of fluid from the annulus 131 to the upper pump volume 122 via the outlet port 128*a* during the downstroke.

In one embodiment, the inlet port 126*a* forms a fluid pathway from the annulus 130 to the upper pump volume 122. In one embodiment, the inlet port 126*a* is an angled port, as shown in FIGS. 2A and 2B. The inlet port 126*a* includes a seat 208*a* for receiving a second blocking member 207*a* of an intake plate 206*a*. In some embodiments, the second blocking member 207*a* is only free to rotate, if at all, about an axis that is parallel with the inlet port 126*a*. In some embodiments, the second blocking member 207*a* is not free to rotate relative to the inlet port 126*a*. The second blocking member 207*a* may be coupled to the intake plate 206*a*. For example, the intake plate 206*a* and the second blocking member 207*a* may be integrally formed or, alternatively, attached to each other. The second blocking member 207*a* may be attached to the intake plate 206*a* in a similar manner as described in relation to the first blocking member 205*a* and the exhaust plate 204*a*. For example, the second blocking member 207*a* is first disposed in the seat 208*a*, and the intake plate 206*a* is subsequently attached to the second blocking member 207*a* while the second blocking member 207*a* is disposed in the seat 208*a*. The intake plate 206*a* may be attached to the second blocking member 207*a* using any suitable method of adhesion, including brazing, welding, and/or gluing. An intake cage 220*a* may then be attached to the valve body 200*a*. An optional biasing member 222*a* may be disposed between the intake plate 206*a* and the intake cage 220*a* when the intake cage 220*a* is attached to the valve body 200*a*.

The intake plate 206*a* with second blocking member 207*a* is movably disposed in an intake cage 220*a* between an open position (FIG. 2A) and a closed position (FIG. 2B). In one embodiment, the intake plate 206*a* is biased toward the closed position by a biasing member 222*a*, such as a spring, which is disposed between the intake plate 206*a* and the intake cage 220*a*. In the closed position, the second blocking member 207*a* contacts the seat 208*a* to block the inlet port 126*a*, as shown in FIG. 2B. The second blocking member 207*a* may or may not hermetically seal the inlet port 126*a* in the closed position. The biasing member 222*a* and a fluid pressure in the upper pump volume 122 act on the intake plate 206*a* such that the second blocking member 207*a* engages the seat 208*a* to block the inlet port 126*a*. For example, when the fluid pressure in the upper pump volume 122 is greater than the fluid pressure in the annulus 130, the second blocking member 207*a* moves towards the closed position. The second blocking member 207*a* may have any appropriate shape capable of mating with the seat 208*a*, such as a conical solid, a rectangular solid, or an ellipsoid. In one embodiment, the second blocking member 207*a* is a ball. The seat 208*a* may include a mating surface having a contoured profile corresponding to the shape of the second blocking member 207*a*. For example, the mating surface may include a radius cut or, alternatively, a 90 degree cut for engaging the second blocking member 207*a*. The seat 208*a* may also include a carbide insert 224*a* at the mating surface, as shown in FIGS. 2A and 2B.

The intake plate 206*a* moves to the open position during the downstroke, as shown in FIG. 2A. In the open position, the second blocking member 207*a* is configured to allow fluid flow through the inlet port 126*a*. For example, as the upper pump volume 122 increases during the downstroke, the fluid pressure in the upper pump volume 122 decreases. In turn, the fluid pressure differential is increased across the intake plate 206*a* whereby the fluid pressure in the annulus 130 is greater than the fluid pressure in the upper pump volume 122. The fluid pressure in the annulus 130 acts on the second blocking member 207*a*, causing the intake plate 206*a* to compress the biasing member 222*a*. As a result, the second blocking member 207*a* unblocks the inlet port 126*a* by moving away from the seat 208*a*. The second blocking member 207*a* thereby allows fluid flow from the annulus 130 to the upper pump volume 122 via the inlet port 126*a*. Fluid may flow around the second blocking member 207*a* in multiple directions, as indicated by the arrows in FIG. 2A. Because the second blocking member 207*a* is coupled to the intake plate 206*a*, the second blocking member 207*a* is not rotated relative to the intake plate 206*a* during inflow. At least a portion of the second blocking member 207*a* remains above a plane formed by a lower surface 202*a* of the valve body 200*a*, thereby preventing the rotation of the intake plate 206*a* relative to the intake cage 220*a*. In one example, a gap between the second blocking member 207*a* and the mating surface of the seat 208*a* ranges from 0.0005 inches to 0.005 inches when intake plate 206*a* is in the open position. In another example, the gap ranges from 0.001 inches to 0.004 inches. In one embodiment, a stiffness of the biasing member 222*a* prevents a top of the second blocking member 207*a* from moving below the plane formed by the lower surface 202*a*. As a result, the intake plate 206*a* maintains an alignment between the second blocking member 207*a* and the inlet port 126*a* during operation.

FIG. 2B shows the upper valve assembly 116*a* during the upstroke of the pump piston 110. The exhaust plate 204*a* moves to the open position during the upstroke. In the open position, the first blocking member 205*a* is configured to allow fluid flow through the outlet port 128*a*. For example, as the upper pump volume 122 decreases during the upstroke, the fluid pressure in the upper pump volume 122 increases. In turn, a fluid pressure differential is increased across the exhaust plate 204*a* whereby the fluid pressure in the upper pump volume 122 is greater than the hydrostatic pressure in the annulus 131. The fluid pressure in the upper pump volume 122 acts on the first blocking member 205*a*, causing the exhaust plate 204*a* to compress the biasing member 214*a*. As a result, the first blocking member 205*a* unblocks the outlet port 128*a* by moving away from the seat 210*a*. The first blocking member 205*a* thereby allows fluid flow from the upper pump volume 122 to the annulus 131 via the outlet port 128*a*. Fluid may flow around the first blocking member 205*a* in multiple directions, as indicated by the arrows in FIG. 2B. Because the first blocking member 205*a* is coupled to the exhaust plate 204*a*, the first blocking member 205*a* is not rotated relative to the exhaust plate 204*a* during outflow. Due to the relatively high pressure and/or relatively low volume in the outlet port 128*a* per stroke, the exhaust plate 204*a* may travel a relatively short distance to allow sufficient flow out of the upper pump volume 122. In one example, a gap between the first blocking member 205*a* and the mating surface of the seat 210*a* ranges from 0.0005 inches to 0.005 inches when the exhaust plate 204*a* is in the open position. In another example, the gap ranges from 0.001 inches to 0.004 inches. In one embodiment, by traveling a short distance from the seat 210*a*, the first blocking member 205*a* prevents the rotation of the exhaust plate 204*a* relative to the exhaust cage 216*a*. For example, in the open position, at least a portion of the first blocking member 205*a* remains below a plane formed by an upper surface 201*a* of the valve body 200*a*. In one embodiment, a stiffness of the biasing member 214*a* prevents a bottom of the first blocking member 205*a* from moving above the plane formed by the upper surface 201*a*. As a result, the exhaust plate 204*a* maintains an alignment between the first blocking member 205*a* and the outlet port 128*a* during operation.

The intake plate 206*a* with second blocking member 207*a* moves to the closed position during the upstroke of the pump piston 110, as shown in FIG. 2B. For example, the upper pump volume 122 decreases during the upstroke, thereby causing a fluid pressure increase in the upper pump volume 122. In turn, a fluid pressure differential is created across the intake plate 206*a* whereby the fluid pressure in the upper pump volume 122 is greater than the fluid pressure in the annulus 130. The biasing member 222*a* and/or the fluid pressure in the upper pump volume 122 act on the intake plate 206*a* such that the second blocking member 207*a* is urged against the seat 208*a*. As a result, the second blocking member 207*a* blocks the backflow of fluid from the upper pump volume 122 to the annulus 130 via the inlet port 126*a* during the upstroke. In the closed position, intake plate 206*a* may or may not fully block the flow of fluid from upper pump volume 122 to outlet port 128*a*.

In some embodiments, intake plate 206*a* and exhaust plate 204*a* cooperate such that, when the intake plate 206*a* is in a closed position, the exhaust plate 204*a* is in an open position, and vice versa.

Figure 3A:
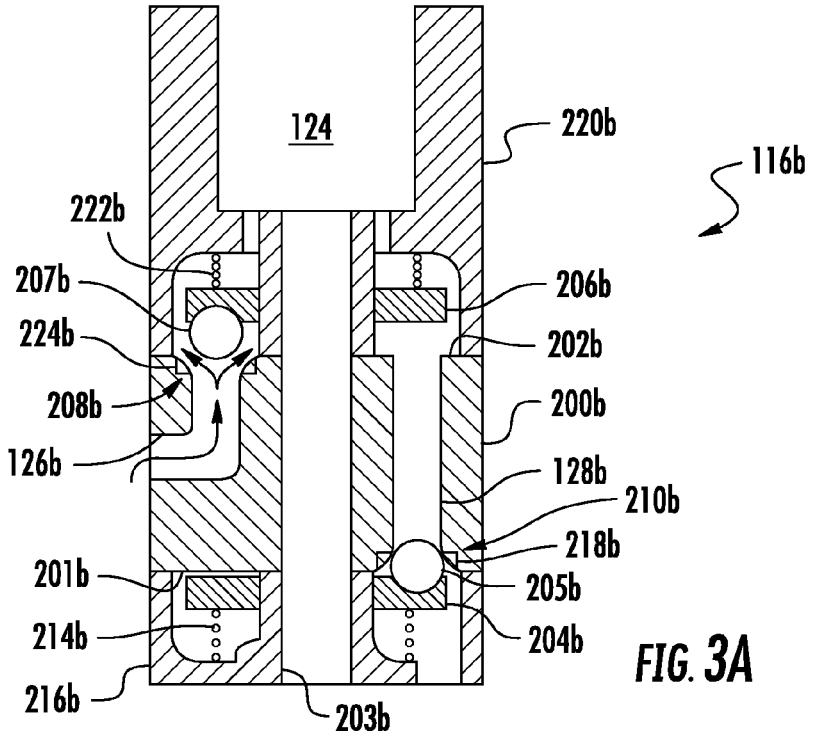
FIG. 3A is a section view of an exemplary lower valve assembly during an upstroke.
Figure 3B:
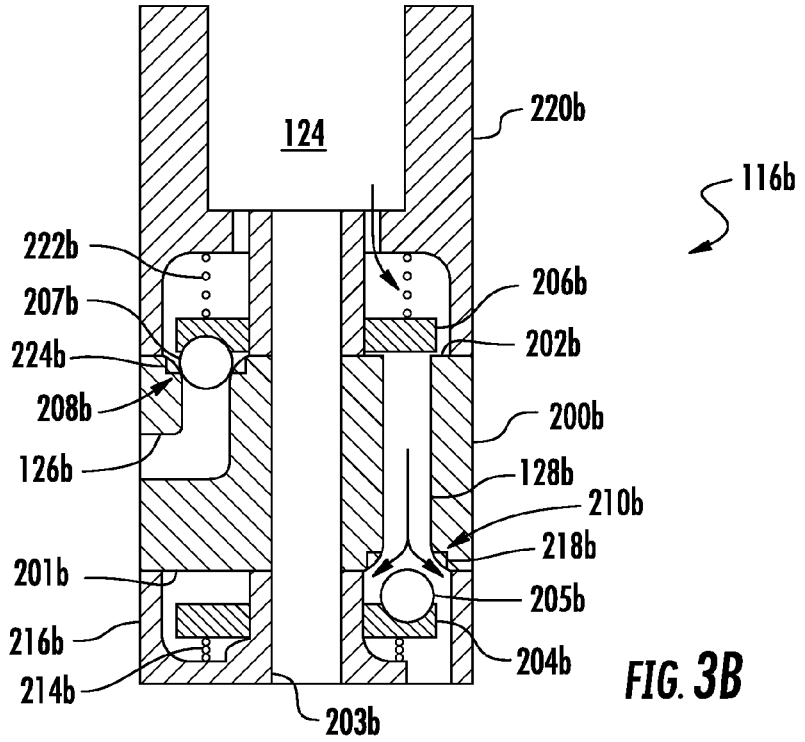
FIG. 3B is a section view of the lower valve assembly of FIG. 3A during a downstroke.

An exemplary embodiment of the lower valve assembly 116*b* is shown in FIGS. 3A and 3B. As previously mentioned, the lower valve assembly 116*b* is constructed in a substantially identical fashion as the upper valve assembly 116*a*. The lower valve assembly 116*b* includes a bore 203*b* therethrough for receiving the rod 114. The lower valve assembly 116*b* also includes a valve body 200*b* having an inlet port 126*b* and an outlet port 128*b*. The outlet port 128*b* forms a fluid pathway from the lower pump volume 124 to the annulus 131. The outlet port 128*b* includes a seat 210*b* for receiving a first blocking member 205*b* of an exhaust plate 204*b*. In some embodiments, the first blocking member 205*b* is only free to rotate, if at all, about an axis that is parallel with the outlet port 128*b*. In some embodiments, the first blocking member 205*b* is not free to rotate relative to the outlet port 128*b*. The first blocking member 205*b* may be coupled to the exhaust plate 204*b*. For example, the exhaust plate 204*b* and the first blocking member 205*b* of the lower valve assembly 116*b* may be integrally formed or, alternatively, attached to each other. The first blocking member 205*b* may be attached to the exhaust plate 204*b* in a similar manner as described in relation to the first blocking member 205*a* and the exhaust plate 204*a*. For example, the first blocking member 205*b* is first disposed in the seat 210*b*, and the exhaust plate 204*b* is subsequently attached to the first blocking member 205*b* while the first blocking member 205*b* is disposed in the seat 210*b*. The exhaust plate 204*b* may be attached to the first blocking member 205*b* using any suitable method of adhesion, including brazing, welding, and/or gluing. An exhaust cage 216*b* may then be attached to the valve body 200*b*. An optional biasing member 214*b* may be disposed between the exhaust plate 204*b* and the exhaust cage 216*b* when the exhaust cage 216*b* is attached to the valve body 200*b*.

The exhaust plate 204*b* is movably disposed in an exhaust cage 216*b* between an open position (FIG. 3B) and a closed position (FIG. 3A). In one embodiment, the exhaust plate 204*b* is biased toward the closed position by a biasing member 214*b*, such as a spring, which is disposed between the exhaust plate 204*b* and the exhaust cage 216*b*. In the closed position, the first blocking member 205*b* contacts the seat 210*b* to block the outlet port 128*b*, as shown in FIG. 3A. The first blocking member 205*b* may or may not hermetically seal the outlet port 128*b* in the closed position. The biasing member 214*b* and the hydrostatic pressure in the annulus 131 act on the exhaust plate 204*b* such that the first blocking member 205*b* engages the seat 210*b* to close the outlet port 128*b*. For example, when the hydrostatic pressure in the annulus 131 is greater than the fluid pressure in the lower pump volume 124, the first blocking member 205*b* moves towards the closed position. The first blocking member 205*b* may have any appropriate shape capable of mating with the seat 210*b*, such as a conical solid, a rectangular solid, or an ellipsoid. In one embodiment, the first blocking member 205*b* is a ball. The seat 210*b* may include a mating surface having a contoured profile corresponding to the shape of the first blocking member 205*b*. For example, the mating surface may include a radius cut or, alternatively, a 90 degree cut for engaging the first blocking member 205*b*. The seat 210*b* may also include a carbide insert 218*b* at the mating surface, as shown in FIGS. 3A and 3B.

In operation, the exhaust plate 204*b* moves to the closed position during the upstroke of the pump piston 110. For example, the lower pump volume 124 increases during the upstroke, thereby causing a fluid pressure decrease in the lower pump volume 124. In turn, a fluid pressure differential is created across the exhaust plate 204*b* whereby the hydrostatic pressure in the annulus 131 is greater than the fluid pressure in the lower pump volume 124. The biasing member 214*b* and/or the hydrostatic pressure in the annulus 131 act on the exhaust plate 204*b* such that the first blocking member 205*b* is urged against the seat 210*b*. As a result, the first blocking member 205*b* blocks the backflow of fluid from the annulus 131 to the lower pump volume 124 via the outlet port 128*b* during the upstroke.

In one embodiment, the inlet port 126*b* forms a fluid pathway from the annulus 130 to the lower pump volume 124. In one embodiment, the inlet port 126*b* is an angled port, as shown in FIGS. 3A and 3B. The inlet port 126*b* includes a seat 208*b* for receiving a second blocking member 207*b* of an intake plate 206*b*. In some embodiments, the second blocking member 207*b* is only free to rotate, if at all, about an axis that is parallel with the inlet port 126*b*. In some embodiments, the second blocking member 207*b* is not free to rotate relative to the inlet port 126*b*. The second blocking member 207*b* may be coupled to the intake plate 206*b*. For example, in one embodiment, the intake plate 206*b* and the second blocking member 207*b* are integrally formed or, alternatively, attached to each other. The second blocking member 207*b* may be attached to the intake plate 206*b* in a similar manner as described in relation to the second blocking member 207*a* and the intake plate 206*a*. For example, the second blocking member 207*b* is first disposed in the seat 208*b*, and the intake plate 206*b* is subsequently attached to the second blocking member 207*a* while the second blocking member 207*b* is disposed in the seat 208*b*. The intake plate 206*b* may be attached to the second blocking member 207*b* using any suitable method of adhesion, including brazing, welding, and/or gluing. An intake cage 220*b* may then be attached to the valve body 200*b*. An optional biasing member 222B may be disposed between the intake plate 206*b* and the intake cage 220*b* when the intake cage 220*b* is attached to the valve body 200*b*.

The intake plate 206*b* is movably disposed in an intake cage 220*b* between an open position (FIG. 3A) and a closed position (FIG. 3B). In one embodiment, the intake plate

206*b* is biased toward the closed position by a biasing member 222*b*, such as a spring. In the closed position, the second blocking member 207*b* contacts the seat 208*b* to block the inlet port 126*b*, as shown in FIG. 3B. The second blocking member 207*b* may or may not hermetically seal the inlet port 126*b* in the closed position. The biasing member 222*b* and the fluid pressure in the lower pump volume 124 act on the intake plate 206*b* such that the second blocking member 207*b* engages the seat 208*b* to block the inlet port 126*b*. For example, when the fluid pressure in the lower pump volume 124 is greater than the pressure in the annulus 130, the second blocking member 207*b* moves towards the closed position. The second blocking member 207*b* may have any appropriate shape capable of mating with the seat 208*b*, such as a conical solid, a rectangular solid, or an ellipsoid. In one embodiment, the second blocking member 207*b* is a ball. The seat 208*b* may include a mating surface having a contoured profile corresponding to the shape of the second blocking member 207*b*. For example, the mating surface may include a radius cut or, alternatively, a 90 degree cut for engaging the second blocking member 207*b*. The seat 208*b* may also include a carbide insert 224*b* at the mating surface, as shown in FIGS. 3A and 3B.

The intake plate 206*b* moves to the open position during the upstroke of the pump piston 110, as shown in FIG. 3A. In the open position, the second blocking member 207*b* is configured to allow fluid flow through the inlet port 126*b*. For example, as the lower pump volume 124 increases during the upstroke, the fluid pressure in the lower pump volume 124 decreases. In turn, a fluid pressure differential is created across the intake plate 206*a* whereby the pressure in the annulus 130 is greater than the fluid pressure in the lower pump volume 124. The fluid pressure in the annulus 130 acts on the second blocking member 207*b*, causing the intake plate 206*b* to compress the biasing member 222*b*. As a result, the second blocking member 207*b* unblocks the inlet port 126*b* by moving away from the seat 208*b*. The second blocking member 207*b* thereby allows fluid flow from the annulus 130 to the lower pump volume 124 via the inlet port 126*b*. Fluid may flow around the second blocking member 207*b* in multiple directions, as indicated by the arrows in FIG. 3A. Because the second blocking member 207*b* is coupled to the intake plate 206*b*, the second blocking member 207*b* is not rotated relative to the intake plate 206*b* during inflow. At least a portion of the second blocking member 207*b* remains below a plane formed by an upper surface 202*b* of the valve body 200*b*, thereby preventing rotation of the intake plate 206*b* relative to the intake cage 220*b*. In one example, a gap between the second blocking member 207*b* and the mating surface of the seat 208*b* ranges from 0.0005 inches to 0.005 inches when the intake plate 206*b* is in the open position. In another example, the gap ranges from 0.001 inches to 0.004 inches. In one embodiment, a stiffness of the biasing member 222*b* prevents a bottom of the second blocking member 207*b* from moving above the plane formed by the upper surface 202*b*. As a result, the intake plate 206*b* maintains an alignment between the second blocking member 207*b* and the inlet port 126*b*.

FIG. 3B shows the lower valve assembly 116*b* during the downstroke of the pump piston 110. The exhaust plate 204*b* moves to the open position during the downstroke. In the open position, the first blocking member 205*b* is configured to allow fluid flow through the outlet port 128*b*. For example, as the lower pump volume 124 decreases during the downstroke, the fluid pressure in the lower pump volume 124 increases. In turn, a fluid pressure differential is increased across the exhaust plate 204*b* whereby the fluid pressure in the lower pump volume 124 is greater than the hydrostatic pressure in the annulus 131. The fluid pressure in the lower pump volume 124 acts on the first blocking member 205*b*, causing the exhaust plate 204*b* to compress the biasing member 214*b*. As a result, the first blocking member 205*b* unblocks the outlet port 128*b* by moving away from the seat 210*b*. The first blocking member 205*b* thereby allows fluid flow from the lower pump volume 124 to the annulus 131 via the outlet port 128*b*. Fluid may flow around the first blocking member 205*b* in multiple directions, as indicated by the arrows in FIG. 3B. Because the first blocking member 205*b* is coupled to the exhaust plate 204*b*, the first blocking member 205*b* is not rotated relative to the exhaust plate 204*b* during outflow. The first blocking member 205*b* prevents the rotation of the exhaust plate 204*b* relative to the exhaust cage 216*b*. In one example, a gap between the first blocking member 205*b* and the mating surface of the seat 210*b* ranges from 0.0005 inches to 0.005 inches when the exhaust plate 204*b* is in the open position. In another example, the gap ranges from 0.001 inches to 0.004 inches. In one embodiment, a stiffness of the biasing member 214*b* prevents a top of the first blocking member 205*b* from moving below a plane formed by a lower surface 201*b* of the valve body 200*b*. As a result, the exhaust plate 204*b* maintains an alignment between the first blocking member 205*b* and the outlet port 128*b* during operation.

The intake plate 206*b* moves to the closed position during the downstroke of the pump piston 110. For example, the lower pump volume 124 decreases during the downstroke, thereby causing a fluid pressure increase in the lower pump volume 124. In turn, a fluid pressure differential is created across the intake plate 206*b* whereby the fluid pressure in the lower pump volume 124 is greater than the fluid pressure in the annulus 130. The biasing member 222*b* and/or the fluid pressure in the lower pump volume 124 act on the intake plate 206*b* such that the second blocking member 207*b* is urged against the seat 208*b*. As a result, the second blocking member 207*b* blocks the backflow of fluid from the lower pump volume 124 to the annulus 130 via the inlet port 126*b* during the downstroke. In the closed position, intake plate 206*b* may or may not fully block the flow of fluid from lower pump volume 124 to outlet port 128*b*.

In some embodiments, intake plate 206*b* and exhaust plate 204*b* cooperate such that, when the intake plate 206*b* is in a closed position, the exhaust plate 204*b* is in an open position, and vice versa.

Figure 4:
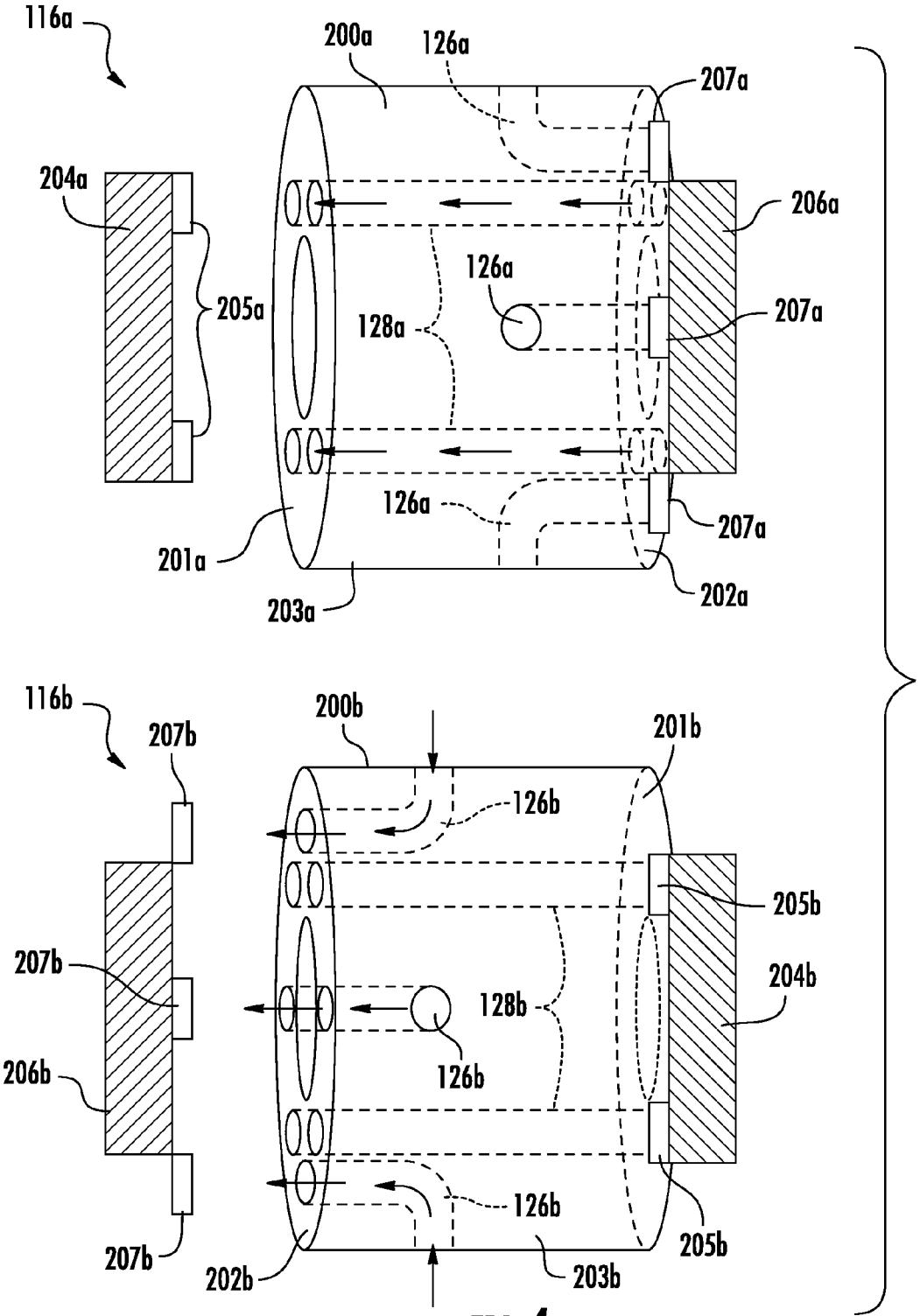
FIG. 4 illustrates the upper valve assembly of FIG. 2A and the lower valve assembly of FIG. 3A during the upstroke.
Figure 5:
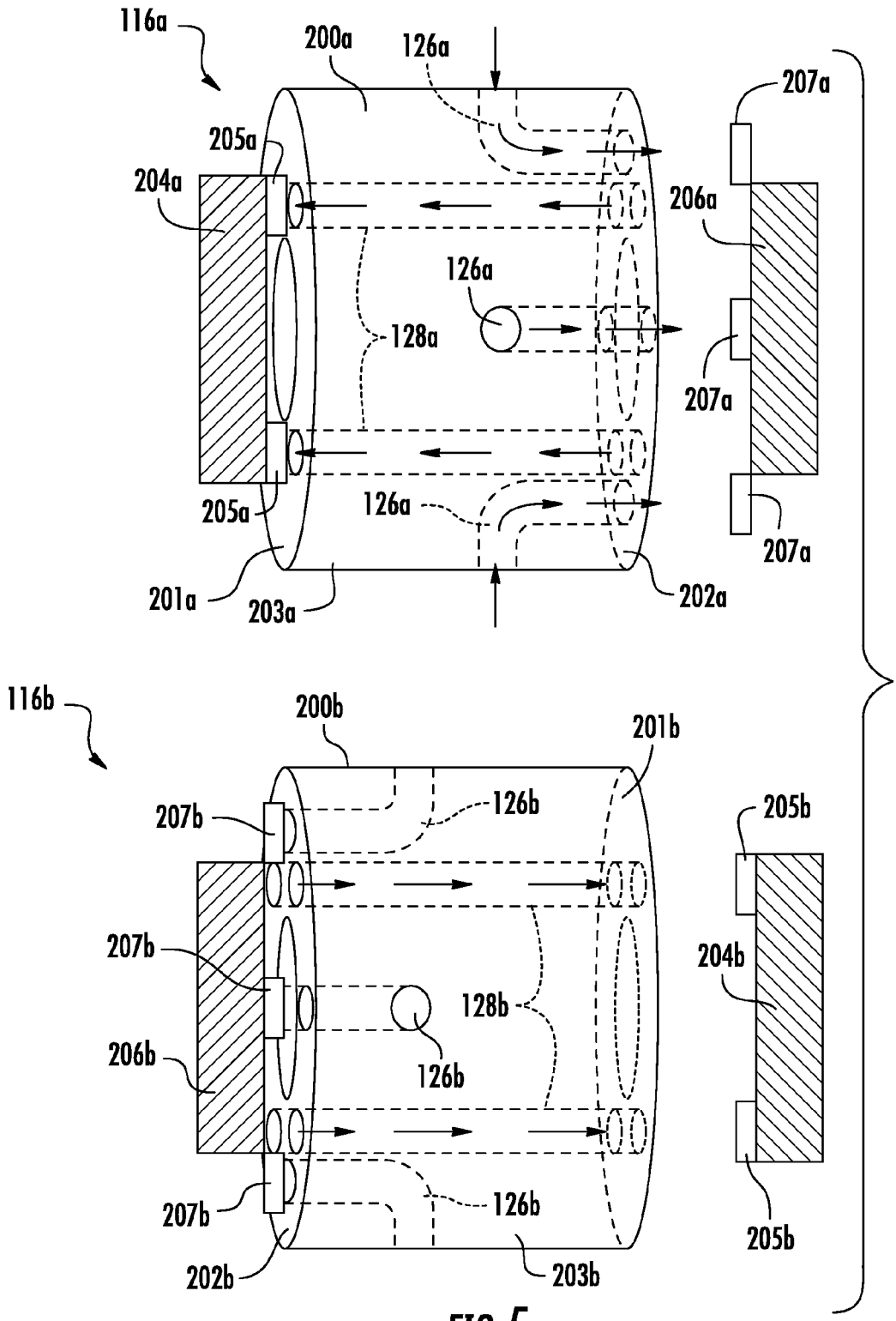
FIG. 5 illustrates the upper valve assembly of FIG. 2A and the lower valve assembly of FIG. 3A during the downstroke.

While the valve body 200 in each upper and lower valve assembly 116*a*, 116*b* only shows a single inlet port 126 and outlet port 128, each valve body 200 may have multiple ports of each type with corresponding blocking members, as is more clearly shown in FIGS. 4 and 5. In one embodiment, the number of inlet ports 126 ranges from 1 to 6. In another embodiment, the number of inlet ports 126 ranges from 2 to 5. In one embodiment, the number of outlet ports 128 ranges from 1 to 10. In another embodiment, the number of outlet ports 128 ranges from 4 to 8. The blocking members 205, 207 of each plate 204, 206 may be arranged circumferentially about the plate to align with respective inlet and outlet ports, as shown in FIGS. 4 and 5.

The upper and lower valve assemblies 116*a*, 116*b* may operate in a complementary manner during alternating pump piston strokes. For example, during the upstroke of the pump piston 110, the exhaust plate 204*a* of the upper valve assembly 116*a* is in the open position while the intake plate 206*a* is in the closed position, as shown in FIG. 4. At the same time, the exhaust plate 204*b* of the lower valve assembly 116*b* is in the closed position while the intake plate

206*b* is in the open position. During the downstroke of the pump piston 110, the exhaust plate 204*a* of the upper valve assembly 116*a* is in the closed position while the intake plate 206*a* is in the open position, as shown in FIG. 5. At the same time, the exhaust plate 204*b* of the lower valve assembly 116*b* is in the open position while the intake plate 206*b* is in the closed position.

In one embodiment, the exhaust plate 204*a* in the upper valve assembly 116*a* may selectively allow fluid flow through the some of the outlet ports 128*a* while blocking fluid flow through other outlet ports 128*a*. During the upstroke, a first portion of the exhaust plate 204*a* may move from the closed position to the open position while a second portion of the exhaust plate 204*a* remains in the closed position. For example, at least one of the first blocking members 205*a* in the first portion of the exhaust plate 204*a* move away from a respective seat 210*a*, thereby allowing fluid flow through the respective outlet port 128*a*. At the same time, at least one of the first blocking members 205*a* in the second portion of the exhaust plate 204*a* remains engaged with a respective seat 210*a*, thereby blocking fluid flow through the respective outlet port 128*a*. In this configuration, the exhaust plate 204*a* is tilted relative to the exhaust cage 216*a*. The exhaust plate 204*b* and the intake plates 206*a*, 206*b* may similarly tilt to selectively allow fluid flow through some ports while blocking fluid flow through other ports during alternating pump piston strokes.

The plates and blocking members described herein may comprise any appropriate material, such as metal, rubber, and/or plastic. Each blocking member may include any appropriate shape, such as a conical solid, a rectangular solid, or an ellipsoid.

In one embodiment, a valve assembly includes a valve body having a first port and a second port, the first port forms a fluid pathway from a first surface of the valve body to a second surface of the valve body, and the second port forms a fluid pathway from the second surface of the valve body to a third surface of the valve body; a first plate having a first blocking member, the first blocking member configured to block the first port at the first surface of the valve body when the first plate is in a first closed position; and a second plate having a second blocking member, the second blocking member configured to block the second port at the second surface of the valve body when the second plate is in a second closed position.

In one or more of the embodiments described herein, the first blocking member is only free to rotate about an axis that is parallel with the first port.

In one or more of the embodiments described herein, the second blocking member is only free to rotate about an axis that is parallel with the second port.

In one or more of the embodiments described herein, the first blocking member is not free to rotate relative to the first port.

In one or more of the embodiments described herein, the second blocking member is not free to rotate relative to the second port.

In one or more of the embodiments described herein, the valve body includes a plurality of first ports and the first plate includes a plurality of corresponding first blocking members.

In one or more of the embodiments described herein, the valve body includes a plurality of second ports and the second plate includes a plurality of corresponding second blocking members.

In one or more of the embodiments described herein, the first blocking member is coupled to the first plate.

In one or more of the embodiments described herein, the first blocking member is formed integrally with the first plate.

In one or more of the embodiments described herein, the first blocking member is attached to the first plate.

In one or more of the embodiments described herein, the first blocking member is brazed to the first plate.

In one or more of the embodiments described herein, the first blocking member is welded to the first plate.

In one or more of the embodiments described herein, the first blocking member is glued to the first plate.

In one or more of the embodiments described herein, the second blocking member is coupled to the second plate.

In one or more of the embodiments described herein, the second blocking member is formed integrally with the second plate.

In one or more of the embodiments described herein, the second blocking member is attached to the second plate.

In one or more of the embodiments described herein, the second blocking member is brazed to the second plate.

In one or more of the embodiments described herein, the second blocking member is welded to the second plate.

In one or more of the embodiments described herein, the second blocking member is glued to the second plate.

In one or more of the embodiments described herein, the first port has a profile at the first surface of the valve body for receiving the first blocking member.

In one or more of the embodiments described herein, the profile in the first port corresponds to a shape of the first blocking member.

In one or more of the embodiments described herein, the second port has a profile at the second surface of the valve body for receiving the second blocking member.

In one or more of the embodiments described herein, the profile in the second port corresponds to a shape of the second blocking member.

In one or more of the embodiments described herein, the first and second plates are configured to operate in a reciprocal manner.

In one or more of the embodiments described herein, the first and second plates are configured to cooperate such that, when the first plate is in the first closed position, the second plate is in an open position, and vice versa.

In one or more of the embodiments described herein, when the first plate is in the first closed position, the second plate is in an open position.

In one or more of the embodiments described herein, when the second plate is in the second closed position, the first plate is in an open position.

In one or more of the embodiments described herein, the first blocking member is configured to hermetically seal the first port.

In one or more of the embodiments described herein, the first blocking member includes a conical solid, a rectangular solid, or an ellipsoid.

In one or more of the embodiments described herein, the first blocking member comprises a metal material, a rubber material, or a plastic material.

In one or more of the embodiments described herein, the second blocking member is configured to hermetically seal the second port.

In one or more of the embodiments described herein, the second blocking member includes a conical solid, a rectangular solid, or an ellipsoid.

In one or more of the embodiments described herein, the second blocking member comprises a metal material, a rubber material, or a plastic material.

In one or more of the embodiments described herein, the valve assembly further includes a first cage, wherein the first plate is movably disposed in the first cage between an open position and the first closed position.

In one or more of the embodiments described herein, the valve assembly further includes a biasing member between the first plate and the first cage for biasing the first plate towards the first closed position.

In one or more of the embodiments described herein, the valve assembly further includes a second cage, wherein the second plate is movably disposed in the second cage between an open position and the second closed position.

In one or more of the embodiments described herein, the valve assembly further includes a biasing member between the second plate and the second cage for biasing the second plate towards the second closed position.

In one or more of the embodiments described herein, the valve assembly also includes a cage assembly configured to facilitate sliding of the first and second plate relative to the valve body, the cage assembly comprising: a first portion having a base between an inner cylindrical section and an outer cylindrical section, the first plate disposed between the inner and outer cylindrical sections of the first portion; and a second portion having a base between an inner cylindrical section and an outer cylindrical section, the second plate disposed between the inner and outer cylindrical sections of the second portion.

In one or more of the embodiments described herein, the valve assembly also includes a biasing member between the first plate and the base of the first portion for biasing the first plate towards the closed position.

In one or more of the embodiments described herein, the valve assembly also includes a biasing member between the second plate and the base of the second portion for biasing the second plate towards the closed position.

In another embodiment, a method of forming a valve assembly includes providing a valve body with a port that forms a fluid pathway from a first surface of the valve body to a second surface of the valve body, wherein the port at the first surface forms a seat; disposing a blocking member in the seat; and attaching a plate to the blocking member disposed in the seat.

In one or more of the embodiments described herein, the method further includes attaching a cage to the valve body, wherein a biasing member is disposed between the plate and the cage.

In one or more of the embodiments described herein, the valve body includes a plurality of ports forming a plurality of seats, and the plate is attached to a plurality of corresponding blocking members disposed in the plurality of seats.

In one or more of the embodiments described herein, attaching the plate to the blocking member includes gluing, welding, and/or brazing the plate to the blocking member.

In another embodiment, a pump assembly includes a pump piston designed to move up and down in alternating strokes between an upper pump volume and a lower pump volume; and a first and second valve assemblies, each valve assembly comprising: a valve body with an outlet port and an inlet port, a first plate having a blocking member coupled thereto for blocking the outlet port when the first plate is in a closed position, and a second plate having a blocking member coupled thereto for blocking the inlet port when the second plate is in a closed position, wherein the first valve assembly allows fluid out of the upper pump volume via the outlet port in the first valve body during an upstroke of the pump piston, and allows fluid into the upper pump volume via the inlet port in the first valve body during a downstroke of the pump piston, and wherein the second valve assembly allows fluid out of the lower pump volume via the outlet port in the second valve body during the downstroke of the pump piston, and allows fluid into the lower pump volume via the inlet port in the second valve body during the upstroke of the pump piston.

In one or more of the embodiments described herein, the valve body includes a plurality of inlet ports and outlet ports, and the first and second plates are coupled to a plurality of blocking members for blocking the respective plurality of inlet and outlet ports.

In another embodiment, a method of pumping fluid from a wellbore includes deploying a pump assembly into the wellbore, the pump assembly having a pump piston and a first and second valve assembly, each valve assembly comprising: a valve body with an outlet port and an inlet port, a first plate coupled with a blocking member for blocking the outlet port when the first plate is in a closed position, and a second plate coupled with a blocking member for blocking the inlet port when the second plate is in a closed position; driving the piston pump in an upstroke, thereby unseating the blocking member of the first plate in the first valve assembly and unseating the blocking member of the second plate in the second valve assembly; and driving the piston pump in a downstroke, thereby unseating the blocking member of the second plate in the first valve assembly and unseating the blocking member of the first plate in the second valve assembly.

In one or more of the embodiments described herein, each valve body includes a plurality of outlet ports, and each first plate is coupled to a plurality of blocking members for blocking the plurality of outlet ports.

In one or more of the embodiments described herein, each valve body includes a plurality of inlet ports, and each second plate is coupled to a plurality of blocking members for blocking the plurality of inlet ports.

In one or more of the embodiments described herein, the blocking member of the first plate is formed integrally with the first plate.

In one or more of the embodiments described herein, the blocking member of the first plate is attached to the first plate.

In one or more of the embodiments described herein, the blocking member of the second plate is formed integrally with the second plate.

In one or more of the embodiments described herein, the blocking member of the second plate is attached to the second plate.

In one or more of the embodiments described herein, driving the piston pump in the upstroke includes: discharging production fluid above the piston pump via the outlet port in the first valve assembly; and collecting production fluid below the piston pump via the inlet port in the second valve assembly.

In one or more of the embodiments described herein, driving the piston pump in the downstroke includes: discharging production fluid below the piston pump via the outlet port in the second valve assembly; and collecting production fluid above the piston pump via the inlet port in the first valve assembly.

In one or more of the embodiments described herein, the outlet port is blocked by seating the blocking member of the first plate on a corresponding profile formed in the valve body.

In one or more of the embodiments described herein, the inlet port is blocked by seating the blocking member of the second plate on a corresponding profile formed in the valve body.

While the foregoing is directed to embodiments of the present invention, other and further embodiments of the invention may be devised without departing from the basic scope thereof, and the scope thereof is determined by the claims that follow.

The invention claimed is:

1. A valve assembly, comprising:

a valve body having a first port and a second port, the first port forms a fluid pathway from a first surface of the valve body to a second surface of the valve body, and the second port forms a fluid pathway from the second surface of the valve body to a third surface of the valve body;

a first plate having a first blocking member attached to the first plate, the first blocking member configured to block the first port at the first surface of the valve body when the first plate is in a first closed position; and a second plate having a second blocking member attached to the second plate, the second blocking member configured to block the second port at the second surface of the valve body when the second plate is in a second closed position;

wherein when the first plate is in a first open position, a biasing member keeps the first blocking member at least partially disposed in the first port.

2. The valve assembly of claim 1, wherein the valve body includes a plurality of first ports, and the first plate includes a plurality of corresponding first blocking members.

3. The valve assembly of claim 1, wherein the first port has a profile at the first surface of the valve body for receiving the first blocking member.

4. The valve assembly of claim 1, wherein the first and second plates are configured to cooperate such that, when the first plate is in the first closed position, the second plate is in an open position, and vice versa.

5. The valve assembly of claim 1, wherein the first blocking member is configured to hermetically seal the first port.

6. The valve assembly of claim 1, wherein the first blocking member includes a conical solid, a rectangular solid, or an ellipsoid.

7. The valve assembly of claim 1, wherein the first blocking member comprises a metal material, a rubber material, or a plastic material.

8. The valve assembly of claim 1, further comprising a first cage, wherein the first plate is movably disposed in the first cage between an open position and the first closed position.

9. The valve assembly of claim 1, wherein the biasing member is disposed between the first plate and the first cage for biasing the first plate towards the first closed position.

10. The valve assembly of claim 1, wherein the valve body includes a plurality of second ports, and the second plate includes a plurality of corresponding second blocking members.

11. The valve assembly of claim 1, wherein the second port has a profile at the second surface of the valve body for receiving the second blocking member.

12. The valve assembly of claim 1, wherein the first port forms a seat for receiving the first blocking member, the seat including a carbide insert.

13. The valve assembly of claim 1, wherein the second port forms a seat for receiving the second blocking member, the seat including a carbide insert.

14. A method of forming a valve assembly, comprising:

providing a valve body with a port that forms a fluid pathway from a first surface of the valve body to a second surface of the valve body, wherein the port at the first surface forms a seat;

disposing a blocking member in the seat, the blocking member only free to rotate about an axis parallel with the port; and attaching a plate to the blocking member disposed in the seat.

15. The method of claim 14, further comprising attaching a cage to the valve body, wherein a biasing member is disposed between the plate and the cage.

16. The method of claim 14, wherein the valve body includes a plurality of ports forming a plurality of seats, and the plate is attached to a plurality of corresponding blocking members disposed in the plurality of seats.

17. The method of claim 14, wherein the seat includes a carbide insert.

18. The method of claim 14, wherein the blocking member comprises a metal material, a rubber material, or a plastic material.

19. The method of claim 14, further comprising disposing the plate in a cage.

20. The method of claim 19, wherein the plate is movable between an open position and a closed position in the cage, the blocking member being disposed in the seat in the closed position.

* * * * *